United States Patent [19]

Tucker

[11] 4,412,405

[45] Nov. 1, 1983

[54] INTERLOCKING BUILDING STRUCTURE

[76] Inventor: Jasper J. Tucker, 4674 Tragen Ct., SE., Salem, Oreg. 97302

[21] Appl. No.: 297,314

[22] Filed: Aug. 28, 1981

[51] Int. Cl.[3] ..... E04B 1/32

[52] U.S. Cl. ..... 52/86; 52/641; 52/643; 52/644; 52/668

[58] Field of Search ..... 52/86, 369, 641, 642, 52/643, 644, 667, 668; 14/3, 24, 25; 135/4 R

[56] References Cited

U.S. PATENT DOCUMENTS

| | | | |
|---|---|---|---|
| 321,939 | 7/1885 | Bates . | |
| 1,272,131 | 7/1918 | Silberg | 52/642 |
| 1,727,022 | 9/1929 | Ahlborn | 52/642 |
| 1,985,599 | 12/1934 | Cates et al. | 52/642 |
| 2,013,820 | 9/1935 | Wilson | 52/642 |
| 2,250,911 | 6/1941 | Hoeckendorf | 52/642 |
| 2,353,071 | 7/1944 | Pitou | 52/642 |
| 2,409,383 | 10/1946 | Pedersen | 52/642 |
| 2,478,421 | 8/1949 | Pedersen | 52/642 |
| 2,770,846 | 11/1956 | Findleton | 52/642 |
| 2,874,812 | 2/1959 | Clevett, Jr. . | |
| 2,948,047 | 8/1960 | Peeler et al. . | |
| 3,004,302 | 10/1961 | Nightingale | 52/642 |
| 3,091,002 | 5/1963 | Nicholson | 52/641 |
| 3,692,340 | 9/1972 | Roth . | |
| 4,373,305 | 2/1983 | Russell | 52/641 |

FOREIGN PATENT DOCUMENTS

| | | | |
|---|---|---|---|
| 14144 | 8/1980 | European Pat. Off. | 52/643 |
| 606875 | 5/1933 | Fed. Rep. of Germany | 52/86 |
| 646892 | 6/1938 | Fed. Rep. of Germany | 52/86 |
| 62443 | 6/1955 | France | 52/668 |

*Primary Examiner*—Alfred C. Perham
*Assistant Examiner*—Mark J. Sofia
*Attorney, Agent, or Firm*—Klarquist, Sparkman, Campbell, Leigh, Whinston & Dellett

[57] ABSTRACT

An arch-shaped building structure is constructed from a multiplicity of relatively small but uniform pieces without the use of metal hardware or fasteners and without the use of conventional tools. Overlapping or offset cross members are disposed between substantially parallel stringer members wherein a given cross member supports a given stringer member and in turn is supported between a pair of stringer members parallel to the given stringer member. Ends of cross members offset from the given cross member are supported by said given stringer member, said offset cross members in turn supporting stringer members parallel to said given stringer member. Stringer members are received in upper slots in cross members, while end tabs of the last mentioned cross members are received in upper slots in stringer members parallel to the first stringer members. The weight of the structure places the cross members in interlocked compression such that no fasteners are required for holding the structure together.

8 Claims, 5 Drawing Figures

INTERLOCKING BUILDING STRUCTURE

BACKGROUND OF THE INVENTION

The present invention relates to an interlocking building structure and particularly to such a structure which may be erected without employing hardware in the form of fasteners, pivots, hangers, or the like and without use of conventional tools.

Various kinds of arch structures are known which can be constructed from relatively short and straight wooden members or beams securable together with nails, bolts, pivots or hangers so that the wooden members or beams are angularly related and form chords of a circular arc. Typical examples are illustrated in U.S. Pat. Nos. 1,727,022, T. Ahlborn; 1,985,599, V. K. Cates et al; 2,013,820, W. E. Wilson; 2,250,911, H. R. Hoeckendorf; 2,353,071, E. Pitou; 3,004,302, W. W. Nightingale; and 3,091,002, L. E. Nicholson. Often, the arch structure is in the form of a roof or roof supporting construction and is mounted between a pair of walls or otherwise placed in tension across the diameter of the arch to prevent the arch from collapsing. For the most part the prior art arch-shaped structures could not be formed without hardware, tools, and the requisite skill required for assembly, or without special subassembly construction.

There is, however, a need for simply erected buildings or shelters of various types which may be either temporary or permanent in nature and which can be constructed by a minimum number of persons without requiring tooling or knowledge of construction techniques. For example, it would be of advantage for unskilled individuals to be able to assemble temporary shelters, greenhouses, patio covers, solar collectors and the like from relatively inexpensive and substantially uniform wooden parts which can be disassembled and reassembled elsewhere as desired.

SUMMARY OF THE INVENTION

In accordance with an embodiment of the present invention, an interlocking building structure includes a plurality of rigid elongated stringer members disposed in parallel relation and a plurality of smaller cross members extending crossways in intersecting and interlocking relation with the stringer members. Ones of the cross members are offset from others by approximately half the length of a cross member. A given cross member supports a given stringer member where they intersect, and the given cross member is in turn supported between two stringer members on either side of and parallel to the given stringer member. Ends of cross members offset but adjacent the given stringer member are supported by the given stringer member. Intersecting cross members and stringer members are joined in supporting relationship by means of a slot construction provided in one intersecting member for receiving a portion of the other intersecting member, wherein the weight of the structure brings the cross members under compression.

It is preferred the said cross members each be provided with an upper slot for receiving a stringer member, while the stringer members have upper slots for receiving ends of the cross members. Thus, a given stringer member is received in an upper slot of a given cross member while ends of the same given cross member are received in upper slots in second and third stringer members disposed in parallel relation to the given stringer member. Other cross members, offset from the given cross member by half the length of the cross member, are received in an upper slot in the given stringer member while the aforesaid second and third stringer members are respectively received in upper slots in the offset cross members. The structure places the cross members in interlocked compression wherein the weight of the structure is utilized in maintaining the integrity of the structure. The structure is usually assembled from substantially only two types of pieces, i.e. the stringer members and the cross members, with each being uniform throughout the construction. No fasteners or tools are required in erecting the arch structure from the relatively simple component parts, and no special skill is required by those doing the erecting.

It is therefore an object of the present invention to provide an improved interlocking building construction wherein such construction may be formed from a plurality of simple, economical and relatively uniform pieces without requiring the use of tools or particular skill on the part of those constructing the building.

It is another object of the present invention to provide an improved interlocking building structure which may be easily assembled and easily disassembled and stored in the form of relatively small component elements.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
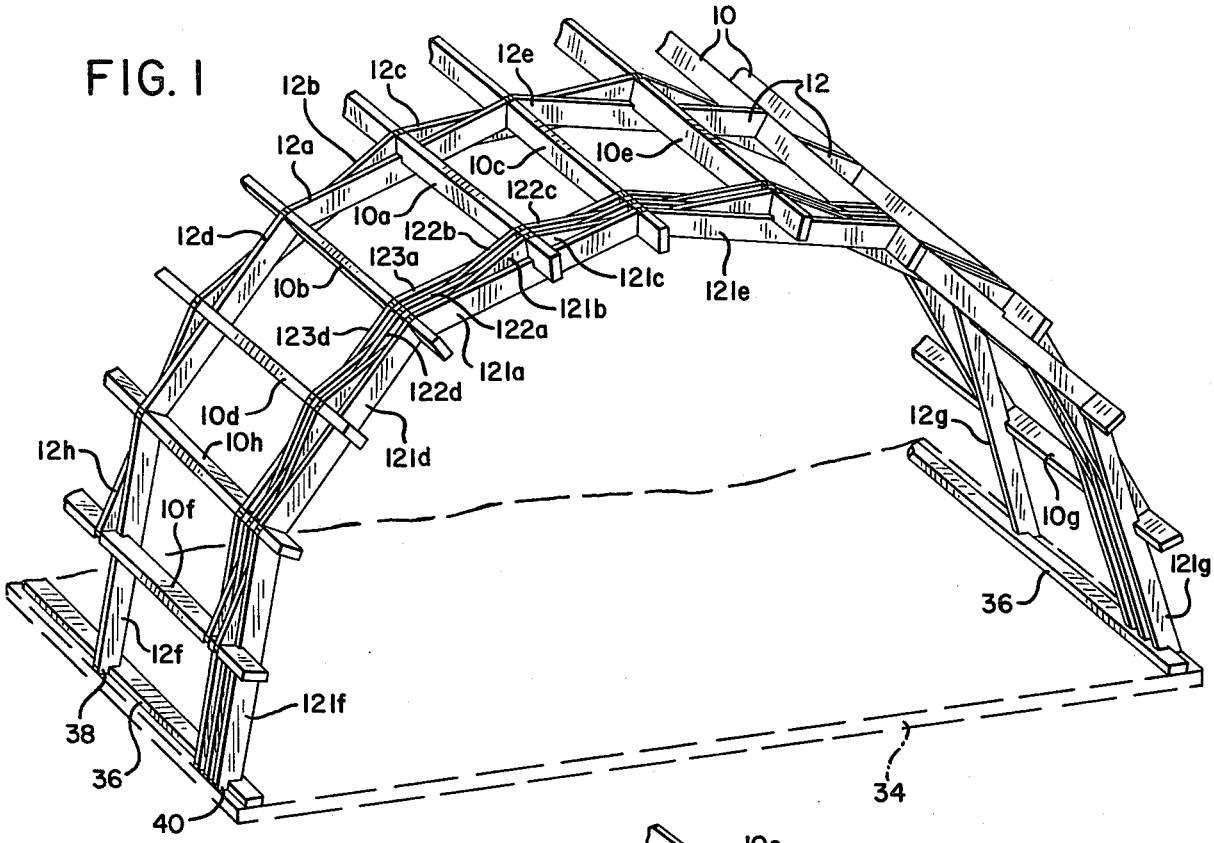
FIG. 1 is a perspective end view, partially broken away, of a structure according to the present invention.

Referring to the drawings and particularly to FIG. 1, a portion of an interlocking building structure according to the present invention is illustrated in perspective. The overall structure is arch-shaped and is suitable for any number of purposes such as greenhouses, solar collector buildings, barns, warehouses, and the like and it is understood only an end portion of the structure is illustrated in FIG. 1. No vertical columns are required for support. The structure includes a plurality of rigid, elongated stringer members 10 disposed substantially on edge and extending in parallel relation to one another in a direction lengthways of the structure, and a plurality of rigid, elongated cross members disposed substantially on edge and positioned crossways of the structure in intersecting and interlocking relation with the stringer members. Said members are suitably board-like, each having a wide dimension and a narrow dimension, and each having interlocking slots positioned along their upper narrow edges as hereinafter more fully described. The stringer members and cross members are suitably formed of wood, although they could be formed of metal, plastic foam, composition, laminated or other substantially rigid material.

To simplify construction, the respective cross members are preferably made all the same size, and the respective stringer members are preferably all the same size. As will be appreciated, the stringer members are each substantially equal in length to the length of the desired structure, while the cross members have a long dimension equal to a fraction of the length of the desired structure. Inasmuch as the finished structure is desirably arch-shaped in cross section, each cross member 12 approximates a segment of the arch or a chord of the circular cross section. The cross members in the illustrated example have a length such that approximately six cross members, extending end-to-end, complete a semicircular arch in the manner hereinafter described.

Figure 2:
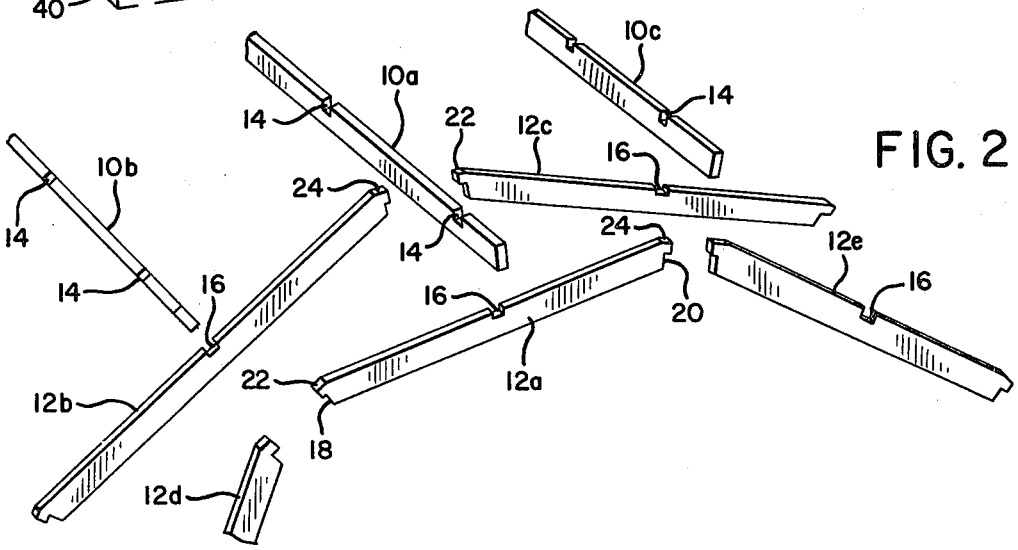
FIG. 2 is an exploded view of a portion of said structure.
Figure 3:
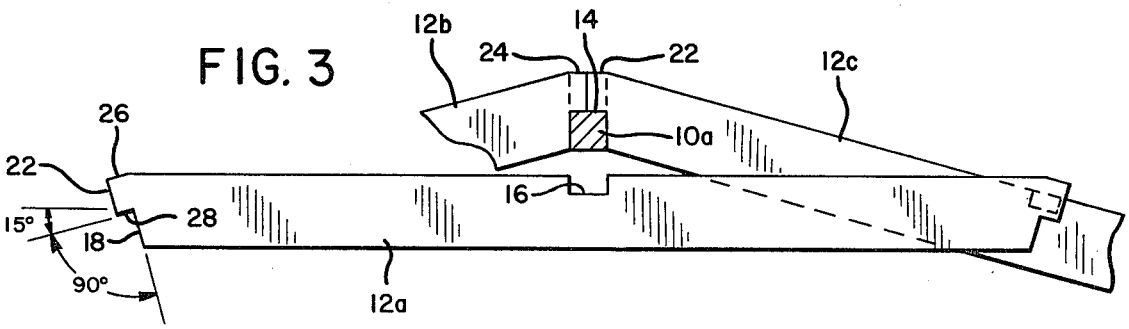
FIG. 3 is a partially exploded view of a portion of said structure.
Figure 4:
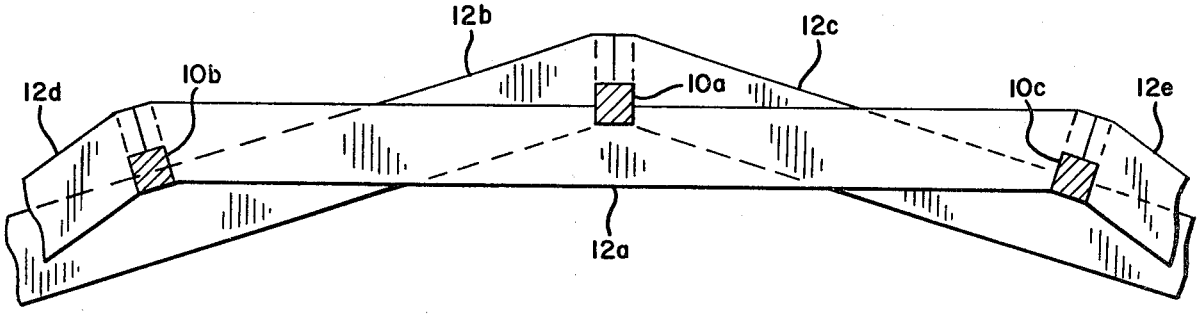
FIG. 4 is a partially broken away cross-sectional view of said structure according to the present invention.

Referring to FIGS. 2 and 3, illustrating the interlocking members in greater detail, a given stringer member 10*a* is provided at spaced intervals along its upper edge with slots 14, said slots extending vertically downwardly from the top edge of the stringer member in square relation with the stringer member and about two-fifths of the way thereacross. A given cross member, 12*a*, disposed in intersecting relation with stringer member 10*a*, is provided at its upper edge with a slot 16 extending vertically downwardly from the top edge in square relation with the cross member. The slot 16 is desirably midway along member 12*a*, extends about one-third of the way across member 12*a*, and is suitable for receiving the lower edge of stringer member 10*a* such that the cross member 12*a* supports the stringer member 10*a*.

Cross member 12*a* is notched at 18 and 20, i.e. ends thereof adjacent the lower edge of the member, to provide tabs 22 and 24 proximate the upper edge of member 12*a*. Each such notch is rectangular and disposed at right angles to the side of member 12*a*, but preferably at an angle of fifteen degrees with respect to the member's longitudinal axis. Top edge 26 at each end of the cross member is beveled downwardly in parallel relation to notch upper edge 28 (see FIG. 3), leaving a rectangular end tab 22 extending downwardly at an angle of fifteen degrees from the longitudinal axis of the member. As will hereinafter become more evident, slots 14 in the stringer members each receive end tabs for a pair of cross members whereby to support the ends of such cross members. Thus, slot 16 of cross member 12*a* receives a stringer member 10*a* for supporting the same, while a slot 14 in the stringer member 10*a* receives end tabs 24 and 22 of other cross members for supporting the same. It will be seen the intersecting cross members and stringer members are joined in supporting relationship in each case by means of a slot provided in one intersecting member for receiving a portion of the other intersecting member, with essentially the same configuration being repeated throughout the structure.

Alternate rows of cross members in the structure are disposed in offset relation, with a given cross member being offset from an adjacent cross member by less than the length of a cross member, and preferably by substantially half the length of a cross member. With the cross members offset by half their length, and with stringer members located centrally of each cross member, an interlocking structure is completed wherein a given cross member 12*a*, supported between two parallel stringer members 10*b* and 10*c* itself supports stringer member 10*a*, while ends of cross members 12*b* and 12*c*, adjacent but offset from cross member 12*a*, are respectively supported between stringer members 10*a* and 10*d* and between stringer members 10*a* and 10*e*. The cross members 12*b* and 12*c* of course support stringer members 10*b* and 10*c*. More particularly, the end tabs 24 and 22 (see FIG. 3) of the pair of offset cross members 12*b* and 12*c* are received in end-to-end abutting relation within slot 14 (shown in cross section in FIG. 3). The rectangular end tabs fit closely in the slot and the angular relationship as hereinbefore described in part results in the arch-type configuration, the cross members such as 12*b* and 12*c* being disposed thereby at an angle of thirty degrees with respect to one another. Moreover, the ends of successive cross members actually extend upwardly or outwardly over successive stringer members that support the cross member. Each cross member being disposed at an angle to the next results in an arch structure even though the cross members are substantially straight. The slot 14 has a width, along the stringer member, for closely receiving the tabs 24 and 22 with a reasonably close tolerance such that the long sides of cross members 12 are disposed vertically.

It is desirable that rows of offset cross members be disposed in pairs as illustrated in FIG. 1 in close interlocking relation, wherein a given cross member 12*a* abuts the adjacent but offset cross members 12*b* and 12*c*. This structure is repeated along the building, except for the ends thereof which will be more fully described. Therefore, a given cross member 12*a* is positioned with its slots 16 offset but immediately adjacent the slot 14 in the stringer member 10*a* thereabove. FIG. 3 illustrates the construction in somewhat exploded fashion and it will be appreciated the stringer member 10*a* fits downwardly into slot 16, the latter receiving the same with reasonably close tolerance so as to support the stringer member in substantially vertical or upstanding relation. The term vertical or upstanding with respect to the stringer members is understood to mean radially away from the center or central ground level of the arch.

Figure 5:
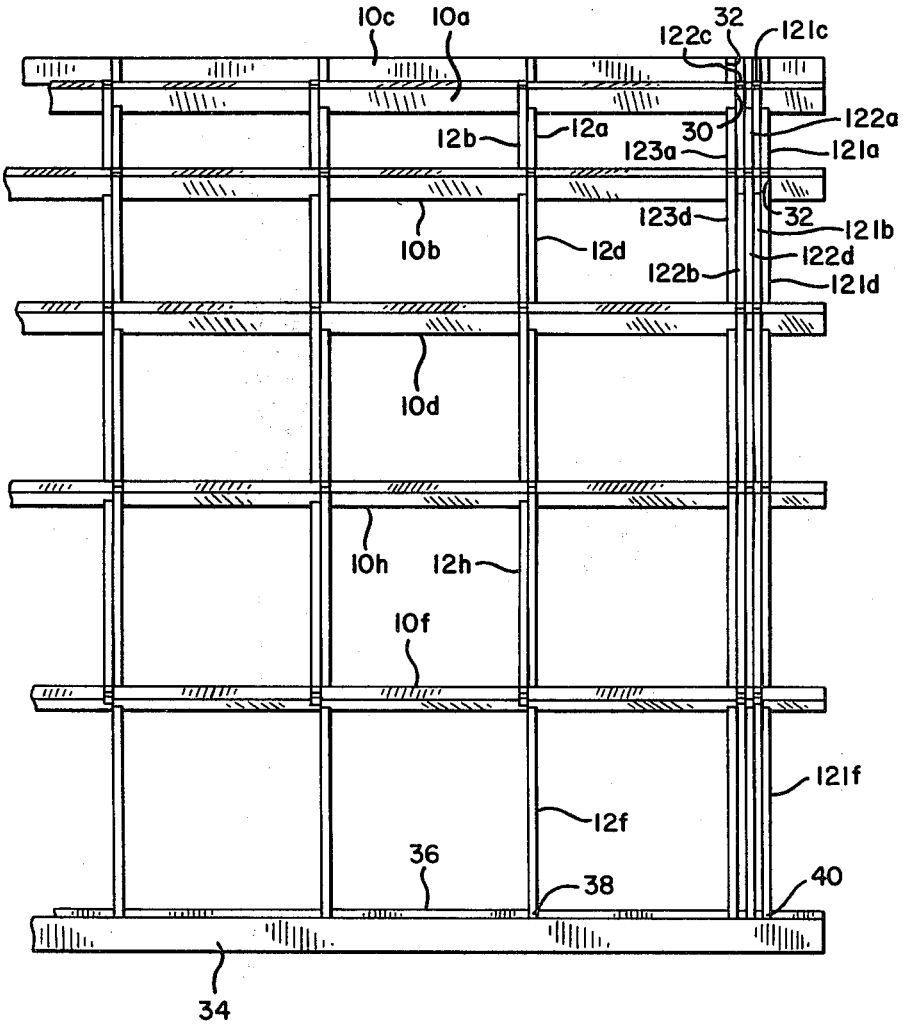
FIG. 5 is a side view, partially broken away, of said structure.

At the ends of the structure in order to provide added stiffening, cross members are laminated in groups of five rather than two. Thus, for example, as illustrated in FIGS. 1 and 5, given cross members 121*a*, 122*a*, and 123*a*, are separated by interleaved offset cross members 121*b* and 122*b* on one side of stringer 10*a* (the left side in FIG. 1), and are separated by offset cross members 121*c* and 122*c* on the other side of stringer 10*a* (the right side in FIG. 1). The individual cross members 121–123 are in fact the same in individual construction as the cross members 12 hereinbefore described. However, the stringers are slotted differently at their ends. It will thus be observed, for example, that ends of three adjacent cross members 121*a*, 122*a* and 123*a* (as separated by offset cross members 121*b*, 122*b*, 121*c*, 122*c*) are received in upper slots 32 in stringer members 10*b* and 10*c*. Moreover, for example, ends of offset cross members 121*b*, 122*b*, 121*c*, 122*c* (as separated by cross member 122*a*) are received in upper slot 30 in stringer member 10*a*. Slots 32 are wide enough to accommodate the thickness of five cross members with fairly close tolerance, while slot 30 is wide enough to accommodate the thickness of three cross members with fairly close tolerance, such that the cross members are held in vertical, upright position, i.e. on edge. This multiple, overlapping cross member construction is preferred at the ends of the building, although, of course, it may be substituted for the double or paired cross member construction along the building as well. The interlocking of the five-cross-member construction (or any odd number of adjacent cross members totaling three or greater) interlocks the structure in such a way as to prevent relative longitudinal movement between adjacent parallel stringer members.

The structure is suitably mounted on a foundation or other base 34 having parallel wooden plates 36 secured thereto in any conventional manner, the plates 36 suitably comprising the same size boards as stringers 10 but disposed flatways along the foundation at the respective edges of the structure. The plates 36 are spaced to receive the lower ends of cross members 12*f* and 12*g* thereupon, wherein the downwardly directed end tabs of cross members 12*f* and 12*g* hook over the plates 36 as indicated, for example, at 38. Of course, the multiple cross member end structure hooks over the plates 36 in a similar manner as indicated at 40. Although in the illustrated embodiment no offset cross members are shown adjacent lower cross member 12*f*, and no interleaved cross members are indicated adjacent end structure 121*f*, it will be appreciated that half cross members may be disposed thereadjacent and extending downwardly only from stringer member 10*f* to plate 36 for additional strength and bracing purposes. Similarly, half cross members may be extended downwardly adjacent cross member 12*g* and structure 121*g* from stringer member 10*g* to the remaining plate 36.

Any kind of suitable covering may be disposed over the building structure. For example, in case of greenhouse use, transparent plastic sheet material may be secured over the arched structure. Any other translucent or opaque sheet material can be substituted therefor, or conventional structural sheathing or the like may be secured between adjacent stringers. It will be observed the cross member ends disposed in slots 14 of the stringers are beveled at 26 as hereinbefore indicated so as to present flat surfaces along the edge of each stringer member suitable for receiving a covering.

The advantages of the present invention include complete ease of assembly wherein the base structure may be erected without fasteners, hangers, pivots or other hardware. The structure may be erected from a plurality of substantially uniform and lightweight pieces, it being observed that all the cross members are substantially identical, and all the stringer members, as well as the supporting plates, are substantially identical for a building of a given length. The structure is suitably started by first securing one of the plates 36 to a foundation or other base, or even on the ground, after which a first section, e.g. comprising cross members including member 12*f* supporting a given stringer member 10*f*, is assembled next to the plate. A stringer 10*h* is inserted under the inward ends of the first row of cross members including member 12*f*. Stringer member 10*h* is then raised slightly and a further row of cross members including member 12*h* is inserted thereunder in hooking relation to both stringer members 10*f* and 10*h* such that one end of a member 12*h* is inserted in a slot 14 of stringer member 10*f*, while the central slot 16 of the cross member 12*h* receives stringer member 10*h*. Construction can proceed in this manner by hand until a complete semicircular arch is constructed. In the case of relatively large structures having somewhat heavy stringer members and cross members, the raising of each section from the ground in order to facilitate hooking engagement of the next row of cross members under the last stringer member may be accomplished with a pair of jacks or the like disposed at ends of the last laid stringer member for raising the same.

As indicated, the structure has the advantage that no hangers, fasteners or the like are required during construction. The structure is secured by its own weight, inasmuch as the respective cross members are disposed in compression between successive stringer members they bridge. That is, a given cross member such as member 12*a* is disposed in compression between stringer members 10*b* and 10*c*, and therefore the end tabs of member 12*a* will remain in engaging relation with slots 14 on stringer members 10*b* and 10*c*. Of course stringer member 10*a* is not only supported by cross member 12*a*, but holds the same down so that the end tabs of member 12*a* will not raise out of slots 14 in members 10*b* and 10*c*. Frictional engagement of the multiplicity of members and especially between adjacent offset cross members and of the various members in the various slots aids in retaining the integrity of the construction. Of course, after the building is erected, fasteners may be provided if a permanent building structure is desired. Thus, overlapping cross members can be bolted or nailed together. However, the erection of the building frame is facilitated without requiring these elements, and in the event the structure is to be temporary, it is easily disassembled into its component members and stored for erection elsewhere. The building is suitable for use as a greenhouse, solar collector, patio cover, swimming pool cover, storehouse, storm shelter, animal shelter, temporary farm building, or for many other purposes as will occur to those skilled in the art.

While a 180 degree, semi-circular structure is illustrated and described herein, a structure according to the present invention may take on other forms. Thus, a complete 360 degree structure, duplicating the present structure in full circular or tubular cross section, is useful for tunnel support and the like. Also a dome-shaped structure is possible wherein short stringer members are employed, and wherein the stringer members are incrementally smaller proceeding upwardly from a substantially round bottom to a common apex or ring as a stringer member at the top.

While I have shown and described a preferred embodiment of my invention, it will be apparent to those skilled in the art that many other changes and modifications may be made without departing from my invention in its broader aspects. I therefore intend the appended claims to cover all such changes and modifications as fall within the true spirit and scope of my invention.

I claim:

1. An interlocking building structure comprising:

a plurality of rigid elongated stringer members and a plurality of rigid elongated cross members for positioning crossways of said stringer members, said cross members each being provided with an upper slot intermediate ends thereof for receiving a stringer member, said stringer members having upper slots for receiving ends of cross members, ones of said cross members being offset from one another so that their upper slots receive different stringer members, wherein a given stringer member is received in an upper slot of a given cross member while ends of said given cross member are received in upper slots in second and third next adjacent stringer members on either side of said given stringer member, an end of a cross member offset from said given cross member being received in an upper slot in said given stringer member while said second and third stringer members are respectively received in upper slots in offset cross members.

2. An interlocking arch structure comprising:

a plurality of rigid elongated stringer members for positioning lengthways of said structure and a plurality of rigid elongated cross members for positioning crossways of said structure, said stringer members extending in substantially parallel relation to one another with said cross members extending crossways thereof in intersecting relation, ones of said cross members being offset from other cross members by less than the length of a cross member, wherein a given cross member supports a given stringer member and in turn is supported between two stringer members parallel to said given stringer member, ends of cross members offset from said given cross member being supported by said given stringer member, said offset cross members in turn supporting stringer members parallel to said given stringer member, intersecting cross members and stringer members being joined in supporting relationship by means of notched connections centrally of said cross members where said stringer members are supported, and notched connections at ends of said cross members where said cross members are supported by said stringer members, the weight of the structure bringing the ends of said cross members under compression.

3. The structure according to claim 2 wherein said cross members define an arch-shaped structure wherein ends of successive cross members extend outwardly over stringer members supporting said cross members.

4. An interlocking arch structure comprising:

a plurality of rigid elongated stringer members for positioning lengthways of said structure and a plurality of rigid elongated cross members for positioning crossways of said structure, said cross members each being provided with an upper slot intermediate ends thereof for substantially centrally receiving a stringer member, said stringer members having upper slots for receiving ends of cross members, said stringer members extending in substantially parallel relation to one another with said cross members extending crossways thereof and with ones of said cross members being offset from one another so that their upper slots receive different stringer members, wherein a given stringer member is received in an upper slot of a given cross member while ends of said given cross member are received in upper slots in second and third stringer members parallel to the given stringer member, an end of a cross member offset from said given cross member being received in an upper slot in said given stringer member while said second and third stringer members are respectively received in upper slots in offset cross members.

5. The structure according to claim 4 wherein said cross members which are offset from one another are disposed in pairs in immediately adjacent side-by-side relation wherein the upper slot in a said cross member is substantially immediately next to the upper slot in a stringer member which it supports.

6. The structure according to claim 4 wherein part of said structure includes more than a pair of said cross members in immediately adjacent side-by-side relation with ends of multiple given cross members being received in common slots in said second and third stringer members while ends of offset cross members are received in common slots in said given stringer member.

7. The structure according to claim 4 wherein said stringer members and said cross members comprise boards having a wide dimension and a narrow dimension, with said boards being disposed substantially vertically on edge, said upper slots being located in upper edges thereof.

8. An interlocking building structure comprising:

a plurality of rigid elongated stringer members for positioning lengthways of said structure and a plurality of rigid elongated cross members for positioning crossways of said structure, said cross members each being provided with a central slot at the upper edge thereof for receiving a stringer member, and each cross member being notched at ends thereof to provide end tabs proximate the upper edge of the cross member, said stringer members having slots at spaced intervals along the upper edges thereof for respectively receiving end tabs of a pair of cross members, said stringer members extending in substantially parallel relation to one another with said cross members extending crossways thereof and with adjacent cross members being offset from one another by substantially half their length, wherein a given stringer member is received in a central slot of a given cross member while the end tabs of said given cross member are received in slots in second and third stringer members parallel to the given stringer member on either side thereof, end tabs of a pair of cross members next adjacent said given cross member being received in a slot in said given stringer member while said second and third stringer members are respectively received in central slots in said pair of cross members.

* * * * *